US006366029B1

(12) United States Patent
Billings

(10) Patent No.: US 6,366,029 B1
(45) Date of Patent: Apr. 2, 2002

(54) LAMP BALLAST FOR REDUCING INTERFERENCE CURRENT

(76) Inventor: Keith Billings, 9 Westhill Road, Guelph, Ontario (CA), N1H7R8

( * ) Notice: Subject to any disclaimer, the term of this patent is extended or adjusted under 35 U.S.C. 154(b) by 0 days.

(21) Appl. No.: 09/584,445

(22) Filed: May 31, 2000

(51) Int. Cl.[7] ..... H05B 37/00

(52) U.S. Cl. ..... 315/244; 315/209 R; 315/224; 315/DIG. 5; 315/DIG. 7

(58) Field of Search ..... 315/244, 209 R, 315/224, 226, 239, 291, DIG. 4, DIG. 7, DIG. 2, DIG. 5

(56) References Cited

U.S. PATENT DOCUMENTS 4,184,128 A * 1/1980 Nilssen ..... 315/DIG. 2
6,078,144 A * 6/2000 Twardzik ..... 315/209 R
6,107,751 A * 8/2000 Billings ..... 315/224

* cited by examiner

*Primary Examiner*—Don Wong
*Assistant Examiner*—Thuy Vinh Tran
(74) *Attorney, Agent, or Firm*—Sofer & Haroun. LLP

(57) ABSTRACT

A ballast circuit for supplying AC voltage and current to a gas discharge lamp, mounted in a troffer having a ground connection, upon the application of DC voltage and current. The circuit comprises: a transformer including a first and a second primary winding; first and second transistors, each having base, collector and emitter terminals, wherein the base terminal of each transistor is coupled to a drive terminal of the second primary winding; a constant current flow network coupled to the drive terminal so as to maintain the circuit in an oscillating mode; the first primary winding configured to be coupled across the lamp such that a capacitance at a first end of the lamp relative to the transformer is equal to a capacitance at a second end of the lamp relative to the transformer; and a current supply source coupled to the troffer ground connection. The circuit is configured such that a net current induced via the lamp and the current supply source into the troffer is substantially equal to zero. According to one embodiment, the capacitance at the first and second ends of the lamp is provided by a capacitor.

16 Claims, 2 Drawing Sheets

LAMP BALLAST FOR REDUCING INTERFERENCE CURRENT

FIELD OF THE INVENTION

The present invention is directed to a ballast for gas discharge lamps. More particularly, the invention is directed to a parallel resonant, current-fed ballast circuit which reduces interference currents.

BACKGROUND OF THE INVENTION

Fluorescent lighting is a very common type of illumination. Fluorescent lamps (or gas discharge lamps) function when an electrical arc is established between two electrodes located at opposite ends of the lamp. The electrical arc is established by supplying a proper voltage to the lamp. The lamp is filled with an ionizable gas and a very small amount of vaporized mercury. When the arc is established, collisions occur between the electrons and the mercury atoms, causing the emission of ultraviolet energy. The fluorescent lamps have a phosphorous coating on their inner surface, which transforms the ultraviolet energy into diffused, visible light. In order to establish the electrical arc, and thus turn on the lamp, a high voltage is typically required. However, once the lamp has been turned on, a lesser voltage is required to maintain the lamp's operation.

In order to start and operate a fluorescent lamp, a fluorescent lamp ballast is employed within a lamp enclosure, and is coupled to the ends of the fluorescent lamps. Among other functions (such as limiting the current flow through the lamp once it has already been started), a ballast is a device which provides the appropriate voltage to establish the arc through the lamps. Also employed within the lamp enclosure is a troffer. A troffer is a metallic holder to which the lamps and electronic fittings are mounted, and which acts as a protective enclosure and a reflector for improving the efficiency of the light output. The troffer is typically grounded.

One problem experienced by the typical lamp ballast of the prior art is that it undesirably produces interference current. Electromagnetic interference is electronic noise that is radiated or conducted, at any frequency, by an electronic device during its operation. Conducted electronic noise, in the case of a lamp ballast, can be either common mode conducted noise or differential mode conducted noise, both of which will be explained in greater detail later. Generally, common mode conducted noise refers to parasitic high frequency currents which flow in both the positive and negative voltage supply lines of the circuit simultaneously, with respect to a common ground return current. Differential mode conducted noise generally refers to parasitic high frequency noise which flows in one voltage supply line with respect to the other voltage supply line, and which does not include ground currents.

International standards place limits on the amount of interference current that may be produced by a lamp ballast. In order to comply with these standards, the typical lamp ballast of the prior art employs a filtering arrangement. FIG. 1 is a schematic diagram that illustrates a typical lamp ballast of the prior art that employs a filtering arrangement for reducing interference current.

More particularly, FIG. 1 shows a schematic diagram of a prior art parallel resonant current-fed circuit, coupled to a DC supply voltage source 190, which functions in a fluorescent lighting ballast. Transformer 101 contains a first primary winding comprising windings 111 and 112 and second primary winding comprising windings 121 and 122. Additionally, the first primary windings of transformer 101 is connected in parallel with capacitors 161, 162 and 163. Primary windings 111 and 112, and capacitors 161, 162 and 163 form a tuned circuit, also known as an L-C parallel resonant circuit, and in conjunction with the other components of the circuit, produce an oscillating action upon the introduction of a start-up current.

Linear inductor 151, is coupled to a center tap terminal 105 of first primary winding of transformer 101 so as to provide a substantially constant current signal to the center tap terminal. Linear inductor 151 is also coupled to a drive terminal 102 of the second primary winding of transformer 101 through a resistor 141, so as to provide the start-up current feed to transistors 131 and 132 respectively. The current feed is sufficient to provide the minimum base drive current required by transistors 131 and 132 to start the transistors to operate in an oscillation mode. After the initial start, transistors 131 and 132 are provided a regenerative feedback current drive generated by windings 121 and 122 as explained later.

In the oscillation mode, transistors 131 and 132 are continuously turned on and off, so as to conduct current alternately through each of primary windings 111 and 112. The alternating current flow through the primary windings creates an AC voltage signal which is applied to a series combination of capacitors 162, 163 and lamps 181 and 182 coupled together in parallel. Capacitors 162 and 163 control the current flow through lamps 181 and 182.

A constant current flow network 154, comprising inductor 152, resistor 142 and diode 171, operates to maintain a substantially constant biasing current flow to the base terminals of transistors 131 and 132 respectively. The base-emitter junction of each transistor acts as a diode, and thus blocks any current flow from returning via windings 121 or 122 to drive terminal 102 through the transistors' base-emitter junction, provided that the voltage applied by the drive windings does not exceed the reverse base-emitter breakdown voltage of the transistors (as will be further discussed later). Diode 171 is configured so as to prevent the reverse flow of current in a direction from drive terminal 102 to constant current flow network 154.

The switching back and forth between transistor 131 and transistor 132 is enhanced by the regenerative feedback current from drive windings 121 and 122, and constant current flow network 154. As shown, windings 121 and 122 are disposed between drive terminal 102 and the base terminals of transistors 131 and 132, respectively.

As previously mentioned, the voltage at the base terminal of the transistors and across the windings increases and decreases in accordance with the circuit's oscillating nature, and can be represented by a corresponding sine-wave curve. Since transistors 131 and 132 are alternately being turned on and off, the base voltage of each transistor is 180 degrees out of phase with the other. Significantly, there exists a point within each half-cycle of operation of this circuit when the voltage signal of the base terminal of a transistor and the corresponding drive winding voltage passes through zero. This point occurs when one transistor is turning on while the other transistor is turning off. At this point, the switching action of the circuit may be interrupted because no current would be flowing to compel the corresponding transistor to turn on or off again. In order to prevent the interruption of the switching action and maintain a constant current flow to the drive windings and transistors, the circuit includes constant current flow network 154 as previously described.

The voltages which can be utilized in this circuit are limited by the base-emitter breakdown voltage of the transistors, which is approximately 6.5 to 7 volts. This breakdown voltage limits the voltage level at drive terminal 102 to minus 3.5 volts, because when one of the transistors, e.g.—131, is switched "on" its base-emitter junction acts like a diode to clamp the left-hand side voltage of drive winding 121 to a value near zero or to the common line negative voltage level of power supply 190. At the same time the voltage level at drive terminal 102 and the right-hand side of winding 122 and base terminal of transistor 132 is taken to a negative level by an amount that depends on the number of turns of winding 122, and hence the drive voltage of the windings. Thus, because of the limit imposed by the breakdown voltage of the transistors, the total voltage across windings 121 and 122 cannot exceed 7 volts and only 3.5 volts will be generated at the center of the circuit. Also, since the circuit must maintain a relatively small voltage between the base terminals of the transistors, the resistive value of resistor 142 of constant current flow network 154 is required to be small, i.e.—in the range of 10 to 20 ohms. Applicant's co-pending application, U.S. patent Ser. No. 09/203,070, which is incorporated by reference herein as fully as if set forth in its entirety, discloses a pair of diodes in constant current flow network 154 which permit the drive voltage and the resistive value of resistor 142 to be increased.

FIG. 1 also illustrates schematically troffer 183 to which lamps 181 and 182 are mounted. Lamps 181 and 182 have a parasitic capacitance to troffer 183, which are shown as discrete components CP1 through CP6. It is noted, however, that this parasitic capacitance is actually distributed along the total length of the lamp, its fittings and the wiring, and is represented herein as discrete components CP1 through CP6 for the sake of illustration only. When a high frequency, high voltage supply is provided to lamps 181 and 182 via DC supply source 190, the capacitance results in a current $I_C$ being induced into the troffer housing. This current flows from troffer 183 to common ground return line 184, and is typically in the order of about 45 milliamps.

The filtering arrangement of the circuit is provided by capacitors 191, 192 and 193 and high inductance common mode inductors 153 and 154. This filtering arrangement is employed to reduce the common mode ground return current $I_C$, by placing a high impedance common mode inductance between the oscillator and the grounded input lines. However, this arrangement does not effectively reduce the common mode ground return current. This filtering arrangement is also employed to reduce the differential mode current which flows in inductor 151 and the ground return line, by bypassing the current through capacitor 191.

In addition to being ineffective, the filtering arrangement as shown and described in FIG. 1, and other filtering arrangements of the prior art, are expensive. The additional components required by the filtering arrangement, and the greater complexity of the circuit due to the addition of the filtering components, add considerably to the cost of the ballast circuit. Furthermore, the efficiency of the prior art ballast is reduced by the addition of the filtering arrangement at the input of the ballast.

Therefore, there exists a need for an inexpensive and efficient parallel resonant ballast circuit for a fluorescent lamp which effectively reduces interference currents.

SUMMARY OF THE INVENTION

The present invention describes a ballast circuit for supplying AC voltage and current to a gas discharge lamp, mounted in a troffer having a ground connection, upon the application of DC voltage and current. The circuit comprises: a transformer including a first and a second primary winding; first and second transistors, each having base, collector and emitter terminals, wherein the base terminal of each transistor is coupled to a drive terminal of the second primary winding; a constant current flow network coupled to the drive terminal so as to maintain the circuit in an oscillating mode; the first primary winding configured to be coupled across the lamp such that a capacitance at a first end of the lamp relative to the transformer is equal to a capacitance at a second end of the lamp relative to the transformer; and a current supply source coupled to the troffer ground connection. The circuit is configured such that a net current induced via the a lamp and the current supply source into the troffer is substantially equal to zero. According to one embodiment, the capacitance at the first and second ends of the lamp is provided by a capacitor.

According to one embodiment, the ballast further comprises a DC supply voltage source coupled to the transformer for supplying a variable DC supply voltage. According to another embodiment, the current supply source is a positive supply line of the DC supply voltage source. According to another embodiment, the positive supply line of the DC supply voltage source is further coupled to the drive terminal via a resistor for providing a start-up current. According to another embodiment, the positive supply line of the DC supply voltage source is further coupled to a center tap terminal of the first primary windings. According to another embodiment, the DC supply voltage source has negative and positive supply lines and the circuit further comprises a capacitor coupled to and disposed between the negative and positive supply lines and an inductor disposed in the negative supply line, wherein the circuit is configured to reduce a current flow in one supply line relative to the other supply line. According to another embodiment, the constant current flow network further comprises an inductor coupled in series with a resistor and a diode coupled to the drive terminal of the second primary winding.

The above description sets forth rather broadly the more important features of the present invention in order that the detailed description thereof that follows may be understood, and in order that the present contributions to the art may be better appreciated. Other objects and features of the present invention will become apparent from the following detailed description considered in conjunction with the accompanying drawings. It is to be understood, however, that the drawings are designed solely for the purposes of illustration and not as a definition of the limits of the invention, for which reference should be made to the appended claims.

BRIEF DESCRIPTION OF THE DRAWINGS

In the drawings, in which like reference characters denote similar elements throughout the several views.

It is to be understood that the drawings are not necessarily drawn to scale, but that they are merely conceptual in nature.

DETAILED DESCRIPTION OF THE INVENTION

The present invention, in accordance with one embodiment, is a ballast circuit for supplying AC voltage and current to a gas discharge lamp mounted in a troffer upon the application of DC voltage and current. More specifically, the present invention describes, according to one embodiment, a parallel resonant, current-fed ballast circuit which effectively reduces interference current.

Figure 2:
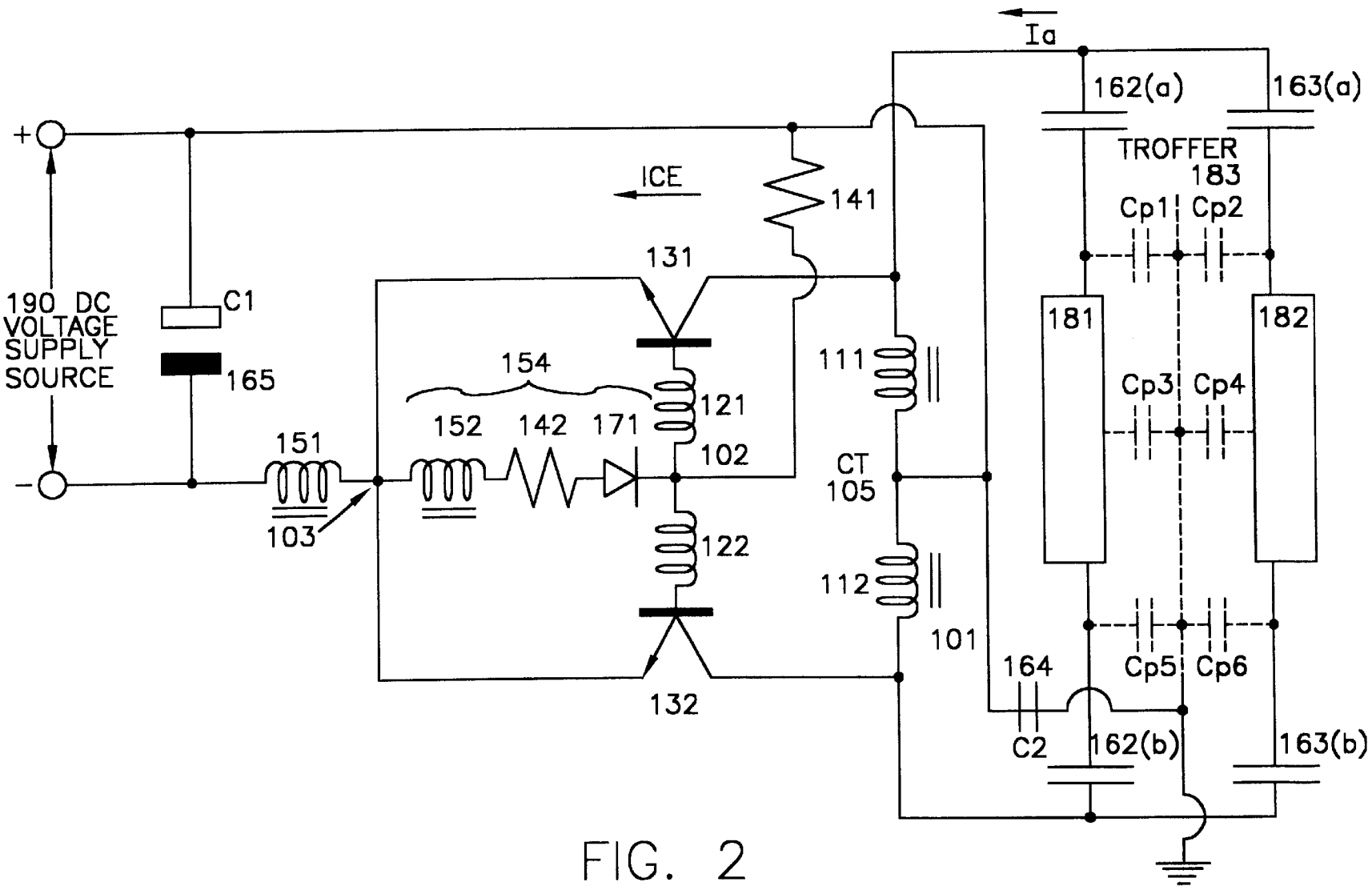
FIG. 2 is a schematic diagram of a parallel resonant, current-fed ballast circuit, in accordance with one embodiment of the present invention.

FIG. 2 illustrates a parallel resonant, current-fed ballast circuit, in accordance with one embodiment of the present invention. The circuit shown in FIG. 2 is suitable to be used in the ballast of a gas discharge lamp. Transformer 101 contains center-tapped primary winding 111 and 112. Winding 111 and 112, and capacitors 162*a,b* and 163*a,b* form a tuned circuit, and in conjunction with the other components of the circuit, generate an oscillating voltage signal, like the one described in the background section, upon the introduction of a start-up current. A DC supply source 190 is coupled to transformer 101 so as to provide a variable DC current. Capacitor 165 is coupled across the negative and positive supply lines of DC supply source 190. Transformner 101 is also coupled to the collector terminals of transistors 131 and 132.

In the embodiment shown in FIG. 2, inductor 151 is disposed in the negative supply line of DC supply source 190. Linear inductor 151 is also connected via constant current flow network 154 to drive terminal 102, which is coupled to and disposed between the base terminals of transistors 131 and 132, respectively. In between drive terminal 102 and the base terminal of transistor 131 is drive winding 121. In between drive terminal 102 and the base terminal of transistor 132 is drive winding 122.

In the embodiment shown, constant current flow network 154 comprises linear inductor 152, resistor 142 and diode 171. Diode 171 is coupled to drive terminal 102, which, as previously mentioned, is coupled to the base terminals of transistors 131 and 132, respectively. Transformer 101 is coupled via winding 111 to capacitors 162*a* and 163*a*, and is coupled via winding 112 to capacitors 162*b* and 163*b*. Disposed between capacitors 162*a* and 162*b* is lamp 181, and disposed between capacitors 163*a* and 163*b* is lamp 182. In this embodiment, the lamps are coupled in parallel with each other and the capacitors are each coupled in series to each lamp. As will be understood, the present invention contemplates the use of a varying number of lamps in various configurations, such as series or parallel arrangements.

Lamps 181 and 182 are mounted in troffer 183. Lamps 181 and 182 have a parasitic capacitance to troffer 183, which is shown as discrete components CP1 through CP6. It is noted, however, that this parasitic capacitance is actually distributed along the total length of the lamp, its fittings and the wiring, and is represented herein as discrete components CP1 through CP6 for the sake of illustration only.

The positive supply line of DC supply source 190 is connected to drive terminal 102 through resistor 141. Also, the positive supply line of DC supply source 190 is connected to center tap 105 of transformer 101, and to ground through capacitor 164. The positive supply line of DC supply source 190 provides a start-up current signal feed to drive terminal 102 via resistor 141. The current signal feed is sufficient to supply the minimum base drive current signal level required by transistors 131 and 132 to start the transistors into an oscillating mode, though other means to begin the oscillation are contemplated by the present invention.

Figure 1:
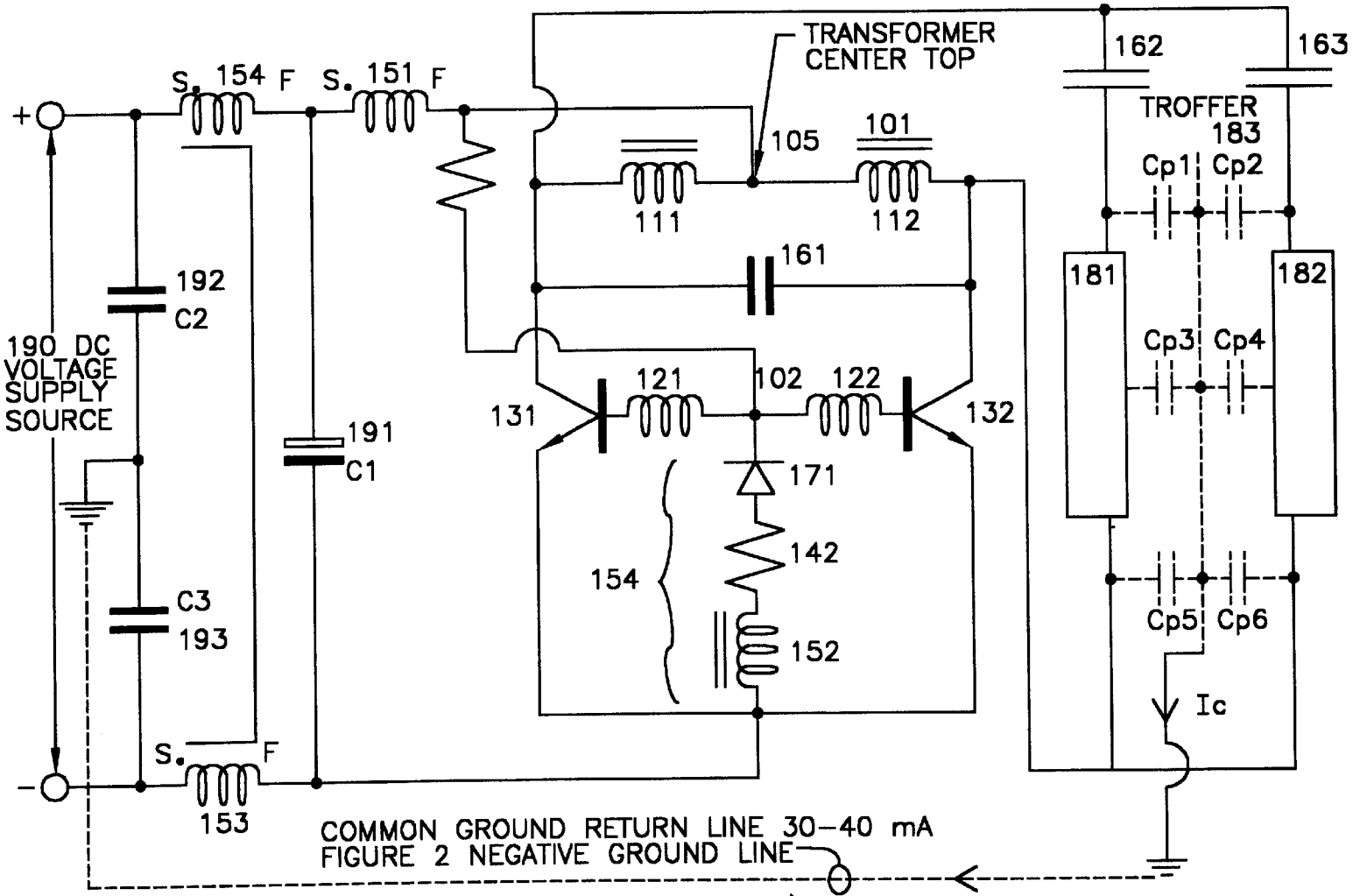
FIG. 1 (PRIOR ART)
FIG. 1 is a schematic diagram of a parallel resonant, current-fed ballast circuit employing a filtering arrangement, in accordance with the prior art.

As described previously in connection with FIG. 1, in the oscillating mode, transistors 131 and 132 are continuously turned "on" and "off", so as to conduct current alternately through each of primary windings 111 and 112. The alternating voltage level across the primary windings creates an AC current flow in the output to the lamps. The impedance of capacitors 162*a,b* and 163*a,b* is greater than the impedance of lamps 181 and 182, and therefore the capacitors dominate the control of the current flow through the lamps.

In a preferred embodiment of the invention, the capacitor at each end of a lamp have the same capacitance value, such that capacitors 162*a* and 163*a* are equal and capacitors 162*b* and 163*b* are equal. Also, in a preferred embodiment of the invention, capacitors 162*a,b* and 163*a,b* have a capacitance value that is twice as large as the capacitance value of capacitors 162 and 163 in FIG. 1. When this is the case, the current in the lamps is the same as the current in the lamps shown in FIG. 1, because of the addition of the two capacitors 162*b* and 163*b*.

In a first half cycle, when a current signal, flowing via resistor 141, arrives at drive terminal 102, the tolerance in the voltage levels at transistors 131 and 132 determine which transistor will turn on first. Specifically, the transistor with the slightly lower base emitter voltage will be turned on first. As a result, a current signal is generated in winding 121 and arrives at drive terminal 102 where it is diverted, depending on its polarity, to, for example, the base terminal of transistor 131, so as to turn "on" transistor 131 and conduct collector-emitter current $I_{CE}$. As transistor 131 starts to turn on, there is an increasing positive voltage at the base terminal of transistor 131, which assists with turning on transistor 131 and is illustrative of the circuit's regenerative feedback feature. As a result, the voltage level at the collector terminal of transistor 131 goes to a saturated low state. The base drive current flows through the base-emitter junction of transistor 131 until it reaches node 103.

At node 103, the base drive current flows upwards into constant current flow network 154. This current cannot flow through the emitter of transistor 132 because the emitter of transistor 132 acts as a diode, in that it blocks any current flow in that direction. However, the present invention contemplates the use of any type of additional device between node 103 and the emitter terminals of transistors 131 and 132 which blocks current from flowing into the emitter terminals of the transistors, as disclosed in applicant's previously referenced co-pending application.

Constant current flow network 154, comprising inductor 152, resistor 142 and diode 171, operates to maintain a substantially constant biasing current flow to the base terminals of transistors 131 and 132 respectively. The base-emitter junction of each transistor acts as a diode, and thus blocks any current flow from returning via windings 121 or 122 to drive terminal 102 through the transistors' base-emitter junction, provided that the voltage applied by the drive windings does not exceed the reverse base-emitter breakdown voltage of the transistors. Diode 171 is configured so as to prevent the reverse flow of current in a direction from drive terminal 102 to constant current flow network 154.

For the second half cycle, transistor 132 conducts a base-emitter current signal which is blocked from flowing through the emitter terminal of transistor 131, because the emitter terminal of transistor 131 acts as a diode. The current instead flows through constant current flow network 154, to be diverted to the base of transistor 131. Since transistor 132 is conducting current, its collector terminal voltage is now low, while transistor 131, (which was turned off when transistor 132 was turned on) has a higher collector terminal voltage. At the end of this second half cycle, the voltage across winding 121 will drop to zero at which time the drive current signal will continue to flow through diode 171 to winding 121 to turn on transistor 131 again. This switching action is repeated in alternating, cyclical fashion, first transistor 131 conducting current in one direction through the primary windings while transistor 132 is turned off, and then transistor 132 conducting current in the opposite direction through the primary windings while transistor 131 is turned off. As previously mentioned, by establishing the oscillation mode of the two transistors, an AC current is developed via capacitors 162 and 163 to operate fluorescent lamps 181 and 182.

As noted above, the switching back and forth between transistor 131 and transistor 132 is enhanced by the regenerative feedback current from drive windings 121 and 122, and constant current flow network 154. When one of the transistors, e.g.—131, is switched "on" its base-emitter junction acts like a diode to clamp the left-hand side voltage of drive winding 121 to a value near zero or to the common line negative voltage level of power supply 190. At the same time the voltage level at drive terminal 102 and the right-hand side of winding 122 and base terminal of transistor 132 is taken to a negative level by an amount that depends on the number of turns of winding 122, and hence the drive voltage of the windings.

The voltage at the base terminal of the transistors and across the windings increases and decreases in accordance with the circuit's oscillating nature, and can be represented by a corresponding sine-wave curve. Since transistors 131 and 132 are alternately being turned on and off, the base voltage of each transistor is 180 degrees out of phase with the other, and there exists a point within each half-cycle of operation of this circuit when the voltage signal of the base terminal of a transistor and the corresponding drive winding voltage passes through zero. This point occurs when one transistor is turning on while the other transistor is turning off. At this point, the switching action of the circuit is maintained by constant current flow network 154 supplying a constant current flow to the drive windings and transistors, as previously described.

The voltage at center tap 105 of transformer 101 increases and decreases in accordance with the circuit's oscillating nature, and can be represented by a corresponding sine-wave curve also. As previously mentioned, the oscillating voltage across transformer 101 establishes an AC current through lamps 181 and 182. However, due to the fact that each lamp has a capacitor disposed at each end having equal capacitance values, transformer 101 is symmetrical. Thus, when one end of the lamps experiences a positive voltage, an equal but opposite negative voltage is experienced at the other end of the lamps.

The result is that parasitic current induced into troffer 183 due to a voltage experienced at one end of the lamp (i.e.—a positive current flow induced from the lamps into the troffer via CP1 and CP2 in one half cycle), is equal but opposite in value to parasitic currents induced into troffer 183 due to the equal but opposite voltage experienced at the other end of the lamp (i.e.—a negative current flow induced from the lamps to the troffer via CP5 and CP6 during the same half cycle). A negative current flow induced from the lamps to the troffer is supplied via the troffer ground line, which, according to one embodiment, is coupled to the positive supply line of DC supply source 190 via capacitor 164. The positive and negative current flows that are induced into the troffer are thus balanced and effectively cancel each other out. Since the net current induced via the lamps into troffer 183 is substantially equal to zero, the common mode conducted noise is effectively reduced, and according to one embodiment, the need for filtering the circuit is substantially eliminated.

Additionally, capacitor 165 effectively eliminates differential mode current noise. As previously mentioned, differential mode conducted noise generally refers to parasitic high frequency noise which flows in one voltage supply line with respect to the other voltage supply line. Capacitor 165, disposed between and coupled to the positive and negative supply lines of DC supply source 190, in conjunction with inductor 151 disposed in the negative supply line of DC supply source 190, equalizes the flow between the positive and negative supply lines and effectively eliminates differential noise.

[Inventor—what is radiated noise and how does this circuit overcome it?]

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, therefore, to be limited only as indicated by the scope of the claims appended hereto.

What is claimed:

1. A ballast circuit for supplying AC voltage and current to a gas discharge lamp mounted in a troffer upon the application of DC voltage and current, said troffer having a ground connection, said circuit comprising:

a transformer including a first and a second primary winding;

first and second transistors, each having base, collector and emitter terminals, said base terminal of each said transistor coupled to a drive terminal of said second primary winding;

a constant current flow network coupled to said drive terminal so as to maintain said circuit in an oscillating mode;

said first primary winding configured to be coupled across said at least one lamp such that a capacitance at a first end of said lamp relative to said transformer is equal to a capacitance at a second end of said lamp relative to said transformer; and a current supply source coupled to said troffer ground connection;

wherein a net current induced via said at least one lamp and said current supply source into said troffer is substantially equal to zero.

2. The apparatus of claim 1, wherein said capacitance at said first and second ends of said at least one lamp is provided by a capacitor.

3. The apparatus of claim 1, further comprising a DC supply voltage source coupled to said transformer for supplying a variable DC supply voltage.

4. The apparatus of claim 3, wherein said current supply source is a positive supply line of said DC supply voltage source.

5. The apparatus of claim 4, wherein said positive supply line of said DC supply voltage source is further coupled to said drive terminal via a resistor for providing start-up current.

6. The apparatus of claim 5, wherein said positive supply line of said DC supply voltage source is further coupled to a center tap terminal of said first primary windings.

7. The apparatus of claim 3, wherein said DC supply voltage source has negative and positive supply lines, said circuit further comprising:

a capacitor coupled to and disposed between said negative and positive supply lines; and an inductor disposed in said negative supply line, wherein said circuit is configured to reduce a current flow in one said supply line relative to said other supply line.

8. The apparatus of claim 1, wherein said constant current flow network further comprises an inductor coupled in series with a resistor and a diode coupled to said drive terminal of said second primary winding.

9. A lighting system providing AC voltage and current to a gas discharge lamp upon the application of DC voltage and current, said system comprising:

a transformer including a first and a second primary winding;

first and second transistors, each having base, collector and emitter terminals, said base terminal of each said transistor coupled to a drive terminal of said second primary winding;

a constant current flow network coupled to said drive terminal so as to maintain said circuit in an oscillating mode;

a troffer having a ground connection;

a lamp coupled across said first primary winding, such that a capacitance at a first end of said lamp relative to said transformer is equal to a capacitance at a second end of said lamp relative to said transformer, said lamp mounted in said troffer; and a current supply source coupled to said troffer ground connection;

wherein a net current induced via said lamp and said current supply source into said troffer is substantially equal to zero.

10. The apparatus of claim 9, wherein said capacitance at said first and second ends of said at least one lamp is provided by a capacitor.

11. The apparatus of claim 9, further comprising a DC supply voltage source coupled to said transformer for supplying a variable DC supply voltage.

12. The apparatus of claim 11, wherein said current supply source is a positive supply line of said DC supply voltage source.

13. The apparatus of claim 12, wherein said positive supply line of said DC supply voltage source is further coupled to said drive terminal via a resistor for providing a start-up current.

14. The apparatus of claim 13, wherein said positive supply line of said DC supply voltage source is further coupled to a center tap terminal of said first primary windings.

15. The apparatus of claim 11, wherein said DC supply voltage source has negative and positive supply lines, said circuit further comprising:

a capacitor coupled to and disposed between said negative and positive supply lines; and an inductor disposed in said negative supply line, wherein said circuit is configured to reduce a current flow in one said supply line relative to said other supply line.

16. The apparatus of claim 9, wherein said constant current flow network further comprises an inductor coupled in series with a resistor and a diode coupled to said drive terminal of said second primary winding.

* * * * *